US006350372B1

(12) United States Patent
Degnan et al.

(10) Patent No.: US 6,350,372 B1
(45) Date of Patent: Feb. 26, 2002

(54) MERCURY REMOVAL IN PETROLEUM CRUDE USING $H_2S$/C

(75) Inventors: Thomas F. Degnan, Moorestown, NJ (US); Steven M. LeCours, Boothwyn, PA (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/313,029

(22) Filed: May 17, 1999

(Under 37 CFR 1.47)

(51) Int. Cl.[7] ..... C10G 25/00; C10G 29/00

(52) U.S. Cl. ..... 208/251 R; 208/182; 208/293; 208/301; 585/820; 585/835

(58) Field of Search ..... 208/182, 213, 208/251 R, 253, 293, 299, 301; 585/820, 835; 423/210, 220

(56) References Cited

U.S. PATENT DOCUMENTS

| | | | | |
|---|---|---|---|---|
| 2,683,683 | A | 7/1954 | Mills | 208/251 R |
| 2,854,399 | A | 9/1958 | Weller | 208/88 |
| 3,542,669 | A | 11/1970 | DeFeo | 208/91 |
| 4,044,098 | A | 8/1977 | Miller et al. | 423/210 |
| 4,094,777 | A | 6/1978 | Sugier et al. | 210/32 |
| 4,430,206 | A | 2/1984 | Rankel | 208/251 R |
| 4,474,896 | A | 10/1984 | Chao | 502/216 |
| 4,551,237 | A | 11/1985 | Fenton | 208/251 R |
| 4,709,118 | A | 11/1987 | Yan | 585/820 |
| 4,877,515 | A | 10/1989 | Audeh | 208/251 R |
| 4,880,527 | A | 11/1989 | Audeh | 208/251 R |
| 4,911,825 | A | 3/1990 | Roussel et al. | 208/251 R |
| 4,915,818 | A | 4/1990 | Yan | 208/251 R |
| 4,950,408 | A | 8/1990 | Duisters et al. | 210/660 |
| 4,966,683 | A | 10/1990 | Audeh | 208/251 H |
| 4,966,684 | A | 10/1990 | Audeh | 208/251 H |
| 4,981,577 | A | 1/1991 | Audeh et al. | 208/251 R |
| 4,983,277 | A | 1/1991 | Audeh et al. | 208/252 |
| 4,985,137 | A | 1/1991 | Audeh | 208/251 H |
| 4,985,389 | A | 1/1991 | Audeh | 502/516 |
| 5,053,209 | A | 10/1991 | Yan | 423/210 |
| 5,107,060 | A | 4/1992 | Yan | 585/823 |
| 5,110,480 | A | 5/1992 | Yan | 210/670 |
| 5,130,108 | A | 7/1992 | Audeh et al. | 423/210 |
| 5,202,301 | A | 4/1993 | McNamara | 502/417 |
| 5,209,913 | A | 5/1993 | Audeh et al. | 423/210 |
| 5,245,106 | A | 9/1993 | Cameron et al. | 585/823 |
| 5,401,392 | A | 3/1995 | Courty et al. | 208/251 H |
| 5,601,701 | A | 2/1997 | Cameron et al. | 208/251 H |
| 5,702,590 | A | 12/1997 | Bonte et al. | 208/251 R |
| 5,736,053 | A | 4/1998 | Ikushima et al. | 210/688 |

FOREIGN PATENT DOCUMENTS

| | | | |
|---|---|---|---|
| EP | 0 352 420 A1 | 1/1990 | |
| EP | 0480603 A2 | 4/1992 | C10G/29/10 |
| EP | 0546740 A1 | 6/1993 | C10L/3/10 |
| FR | 2644472 A1 | 3/1989 | C10G/45/04 |

OTHER PUBLICATIONS

Dumary, R. et al., "Comparison of the Collection of Desorption Efficiency of Activated Charcoal, Silver, and Gold for the Determination of Vapor–Phase Atmospheric Mercury", *Anal. Chem.,* 1985, 57, 2638–2643.

Greenwood, N.N. et al., *Chemistry of the Elements,* 1984, 1396–1399.

*Primary Examiner*—Bekir L. Yildirim
(74) *Attorney, Agent, or Firm*—Charles J. Brumlik

(57) ABSTRACT

The present invention relates to the removal of mercury and other heavy metals from a hydrocarbon feedstream. The process involves contacting the hydrocarbon feedstream with a feedstream-soluble sulfur compound and then contacting the hydrocarbon feedstream and solubilized sulfur compound with an adsorbent.

10 Claims, No Drawings

MERCURY REMOVAL IN PETROLEUM CRUDE USING $H_2S$/C

FIELD OF THE INVENTION

The present invention relates to the removal of mercury and other heavy metals from a mercury-contaminated hydrocarbon feedstream.

BACKGROUND OF THE INVENTION

Hydrocarbon feedstreams, including petroleum crude oils, natural gas, and natural gas condensates, can contain various amounts of mercury. Even in trace amounts, mercury is an undesirable component. The release of mercury by the combustion of mercury-contaminated hydrocarbons pose environmental risks and the accidental release and spill of accumulated mercury can lead to numerous safety hazards. Moreover, the contact of mercury-contaminated feedstreams with certain types of petroleum processing equipment presents additional problems of equipment deterioration and damage. This results when mercury accumulates in equipment constructed of various metals, such as aluminum, by forming an amalgam with the metal. Repair and replacement of the deteriorated processing equipment may be extremely costly.

Numerous methods have been developed for removing mercury from liquid hydrocarbon feedstreams, including petroleum crude oils and natural gas condensates, as well as from hydrocarbon gas streams. For example, U.S. Pat. No. 4,981,577 discloses a process for separating a natural gas wellstream into gaseous and liquid fractions and mixing the hydrogen sulfide containing gaseous fraction (sour gas) with the liquid fraction to form filterable mercury sulfide. However, removal of elemental mercury from gas streams and condensates is relatively facile when compared to the removal of the great variety of mercury compounds, e.g. elemental mercury, inorganic compounds, and organic (alkylated) compounds, often encountered in a far more chemically complex feedstream such as petroleum crude. For example, the particulates and waxy components of a crude oil would likely render a filtering method ineffective due to filter blockage and pore size limitations.

Generally, deleterious metals, such as mercury, are removed from liquid hydrocarbon feedstreams by chemisorption processes which comprise passing the feedstream at elevated temperatures over an adsorbent. U.S. Pat. Nos. 5,107,060 and 5,110,480 describe the removal of mercury from a natural gas condensate containing mercury by contacting the condensate with metals, metal sulfides, or metal oxides on a support such as carbon. The metal component on the adsorbent reacts with the mercury in the condensate feedstream. However, the heavier hydrocarbon fractions of crudes and some condensates may compete too favorably with the mercury and block the active metal sites on the adsorbent, destroying the activity of the adsorbent for mercury removal. Accordingly, these methods require higher temperatures within the adsorbent bed or an increased concentration of the active metal component on the adsorbent.

In particular, the organic (alkylated) mercury compounds present in many crude oil feedstreams are difficult to remove. Unlike elemental mercury and inorganic mercury compounds, the organic mercury compounds are soluble in oil and typically far less reactive than elemental mercury or inorganic mercury compounds. Moreover the solubility and toxicity of the organic mercury compounds makes them dangerous to handle.

EP-A-352,420 describes removing mercury from a natural gas liquid by mixing an aqueous solution of an ammonium or alkali metal sulfide with the liquid hydrocarbon to form insoluble mercury sulfide that can be transferred to the aqueous phase and subsequently separated and removed. In order to remove the organic mercury compounds, the feedstream must be contacted with an adsorbent comprising a heavy metal sulfide. Such a process involves the processing of two relatively immiscible phases, aqueous and oil, and the retention of organic mercury compounds in an adsorbent bed and/or aqueous fraction.

There remains a need to effectively and efficiently treat more complex hydrocarbon feedstreams that contain a variety of mercury compounds, including organic mercury compounds. It has now been discovered that the combination of a feedstream-soluble sulfur compound and an adsorbent is extremely effective in removing mercury from petroleum crudes as well as less complex hydrocarbon feedstreams. In addition, the process has been proven to be effective at moderately low temperatures and has maintained adsorption capacity for prolonged periods of time.

SUMMARY OF THE INVENTION

The invention relates to removing mercury, and other heavy metals such as lead and arsenic, from mercury-contaminated hydrocarbon feedstreams by the combined use of a feedstream-soluble sulfur compound and an adsorbent. As used herein, "feedstream-soluble" refers to a compound that is soluble or miscible in the hydrocarbon feedstream. Generally, the sulfur species is contacted with the hydrocarbon feedstream and both are subsequently passed through an adsorbent bed, which is preferably activated carbon. Typically, the soluble sulfur compounds react readily with the mercury compounds in the feedstream, including the organic (alkylated) mercury compounds found in petroleum crudes, to form mercury sulfide prior to contacting with the adsorbent. The mercury sulfide is readily adsorbed and may be easily recovered from the spent carbon adsorbent.

Accordingly, the process is able to remove mercury from a wide variety of hydrocarbon feedstreams. In particular, it has been discovered that contacting a mercury-contaminated petroleum crude oil feedstream with hydrogen sulfide and then passing that feedstream over activated carbon can effectively remove greater than 99% of the mercury entities in the petroleum crude oil under moderate adsorption temperatures for prolonged periods of time.

DETAILED DESCRIPTION OF THE INVENTION

The hydrocarbon feedstreams to be processed in accordance with the present invention may include any hydrocarbon feedstream containing mercury and/or other heavy metals, and in particular, petroleum crude oils, gas condensates, and gases. The other heavy metals that may be present in these hydrocarbon feedstreams include Pb, Fe, Ni, Cu, V, As, Cd, Sn, Sb, Bi, Se, Te, Co, In, and Tl.

Typically, petroleum crude oils comprise organic, inorganic, and elemental forms of mercury. Crude oils tend to have a brown or black color and a heavy end with an upper end boiling point of greater than about 537° C. and an A.P.I. gravity of less than about 50, more typically, less than about 45. Typical gas condensates comprise organic and elemental forms of mercury. Generally, a gas condensate is a liquid hydrocarbon produced from natural gas and separated from the gas by cooling or various other means of separation. Condensates generally are water-white, straw, or blueish in color with an upper end boiling point of less than about 315° C. and an A.P.I. gravity of greater than about 45. Typical hydrocarbon gas streams, such as natural gas streams, comprise organic and elemental forms of mercury. Generally, the gas streams comprise low molecular weight hydrocarbons such as methane, ethane, propane, and other paraffinic hydrocarbons that are typically gases at room temperature. In preferred embodiments, the process of the present invention may be used to remove mercury from crude oil hydrocarbon feedstreams.

Typically, the feedstreams may comprise about 40 to about 5000 ppb mercury. Some feedstreams may contain from about 2000 to about 100,000 ppb mercury. The mercury content may be measured by various conventional analytical techniques known in the art. For example, cold vapor atomic absorption spectroscopy (CV-AAS), inductively coupled plasma atomic emission spectroscopy (ICP-AES), X-ray fluorescence, or neutron activation may be used to measure mercury content.

According to the present invention, the hydrocarbon feedstream is contacted with a sulfur compound. In preferred embodiments, the sulfur compounds are feedstream soluble or miscible, and in particular, oil soluble or miscible, and may therefore be added to the feedstream as gases, liquids, or an oil soluble solid. Preferred feedstream-soluble compounds which can be employed in the present invention include compounds or mixtures of compounds having the formula:

$$R^1—(S)_x—R^2$$

wherein x is 1 or greater, preferably from about 1 to about 8; and $R^1$ and $R^2$ are each, independently, hydrogen or an organic moiety such as alkyl, alkenyl, alkynyl, or aryl.

"Alkyl" refers to linear, branched or cyclic hydrocarbon groups having from about 1 to about 30 carbon atoms, more preferably from about 1 to about 10 carbon atoms.

"Alkenyl" is an alkyl group containing a carbon-carbon double bond having from about 2 to about 15 carbon atoms, more preferably from about 2 to about 10 carbon atoms.

"Alkynyl" is an alkyl group containing a carbon-carbon triple bond having from about 2 to about 16 carbon atoms, more preferably from about 2 to about 10 carbon atoms.

"Aryl" is an aromatic group containing about 6 to about 18 carbon atoms, more preferably from about 6 to about 14 carbon atoms.

Examples of sulfur compounds include, but are not limited to, hydrogen sulfide, dimethylsulfide, dimethyldisulfide, thiols, polysulfides, and sulfanes. Preferably, the sulfur compound is hydrogen sulfide. In addition, in the case of gaseous sulfur compounds, carrier gases such as hydrogen or methane may be used.

The sulfur compound may be contacted with the hydrocarbon feedstream in conventional manners known in the art. The feedstream-soluble sulfur compounds readily react with the mercury in the feedstream, including the organic mercury compounds, to form mercury-sulfur compounds, namely mercury sulfide, which can be readily adsorbed by the adsorbent. Generally, the sulfur compound will be contacted with the hydrocarbon feedstream through the use of a separate line directed into the feedstream. The contacting may be prior to or simultaneously with the contacting of the feedstream with the adsorbent. In preferred embodiments, the sulfur compounds are contacted with the feedstream prior to the introduction of the feedstream into the adsorbent bed. For example, the sulfur compounds may be contacted with the hydrocarbon feedstream prior to the feedstream being removed from the ground by injecting the sulfur compounds into the feedstream source.

Due to the solubility of the sulfur compounds of the present invention, minimal mechanical mixing of the sulfur compounds with the hydrocarbon feedstream is necessary. In particular, hydrogen sulfide will readily permeate the hydrocarbon feedstream and react with the mercury therein. Preferably, the contacting of the sulfur compound with the feedstream is made at a sufficient distance upstream of the adsorbent bed to provide adequate time to sufficiently contact and react the sulfur compound with the mercury in the feedstream before contact with the adsorbent. If the sulfur compounds are contacted with the feedstream at the adsorbent bed, the flowrate of the sulfur compound through the bed may affect the effectiveness of the contacting, and thus the completeness of the reaction between the mercury in the feedstream and the sulfur compounds. However, to ensure sufficient contact between the sulfur compounds and the mercury in the feedstream, the sulfur compounds may be blended with the feedstream prior to contact with the adsorbent bed by conventional methods known in the art.

In preferred embodiments utilizing hydrogen sulfide, the sulfur compound is fed into the feedstream prior to contacting the feedstream with the adsorption bed through the use of a gas line. The feed rate of the hydrogen sulfide may be controlled by a needle valve attached to the gas line.

The amount of sulfur compound contacted with the hydrocarbon feedstream is dependent on the type of feedstream and the level of mercury contamination in the feedstream. Preferably, there will be at least one mole of elemental sulfur added for every mole of elemental mercury that passes through the adsorption bed. Typically, the amount of sulfur compound that may be contacted with the hydrocarbon feedstream is from about 0.001 to about 0.1 wt % elemental sulfur, more preferably from about 0.01 to about 0.05 wt % elemental sulfur. The amount of sulfur compound may be increased if the desired heavy metal level in the feedstream is not achieved. As previously noted, less sulfur compound may be necessary provided the sulfur compound is contacted with the hydrocarbon feedstream at a sufficient distance upstream of the adsorbent bed to allow a complete reaction between the mercury in the feedstream and the sulfur compound.

The feedstream is also contacted with an adsorbent, and as mentioned above, this preferably occurs after the feedstream is contacted with the sulfur compound. Typically, an adsorbent will comprise a metal on a support of high surface area such as $SiO_2$, $Al_2O_3$, silica-alumina or carbon. However, the adsorbent may also be the support itself. According to the present invention, the adsorbent may be activated carbon, alumina, gold on alumina, or silver on alumina. Preferably, the adsorbent comprises activated carbon. In addition, the adsorbent may be in a moving or fixed bed form, and is preferably in a fixed bed form.

The contact of the mercury-contaminated hydrocarbon feedstream with the absorbent is carried out at temperatures from about 65 to about 232° C., more preferably the temperature is from about 76 to about 148° C. As noted above, in the present invention, the reaction of sulfur compounds with the mercury compounds in the feedstream to form mercury sulfide preferably occurs prior to the adsorbent bed, and as a result, adsorbent bed temperatures are moderate when compared to temperatures used in the prior art.

The hydrocarbon feedstream is passed through the adsorbent bed at a rate of about 0.2 to about 80 liquid hourly space velocity (LHSV), more preferably at a rate of about 5 to about 15 LHSV. Contacting the hydrocarbon feedstream with the adsorbent may be carried out at ambient or elevated pressure.

According to the process of the present invention, the level of mercury, on an elemental basis, removed from the mercury-contaminated feedstream is at least 85%, preferably 90%, more preferably at least 95%, and even more preferably at least 98%. The adsorbed mercury is substantially in the form of mercury sulfide and may be safely and easily handled and recovered from the spent adsorbent.

In preferred embodiments, contacting a mercury contaminated petroleum crude oil with hydrogen sulfide and then subsequently passing the crude over an activated carbon bed has proven to be extremely effective in the removal of mercury from the crude. It is well known that mercury (Hg) will react with hydrogen sulfide ($H_2S$) according to the formula:

$$Hg+H_2S \rightarrow HgS+H_2$$

The role of activated carbon is less clear. Although the relative ineffectiveness of activated carbon alone to remove mercury is well established (see U.S. Pat. No. 5,202,301), the carbon appears to enhance the effectiveness of mercury removal when used with hydrogen sulfide. As demonstrated in the examples that follow, the combined use of hydrogen sulfide and activated carbon has unexpectedly proven to be extremely effective in treating mercury-contaminated hydrocarbon feedstreams, and in particular, crude oil feedstreams.

The present method may also be combined with other methods known in the art for removing mercury from hydrocarbon feedstreams, such as the process disclosed in U.S. Pat. No. 4,915,818, incorporated herein by reference. In addition, the mercury can ultimately be recovered from the spent carbon prior to disposal or regeneration of the carbon by employing several techniques known in the art. For example, such techniques include known industrial processes of producing mercury from cinnabar (HgS). See Greenwood, N. N., Ernshaw, A., *Chemistry Of The Elements,* (1984) at 1398–99.

EXAMPLES

The general procedures described here were followed to test the general effectiveness of a hydrogen sulfide ($H_2S$) and activated carbon system to remove naturally occurring mercury contaminants from an Argentinean petroleum crude. The activated carbon used was a commercially available activated carbon. Properties of the crude are provided in Table 1 and properties of the activated carbon are provided in Table 2:

TABLE 1

| Properties of the Argentinian Crude | |
|---|---|
| Initial Boiling Point | <36° C. |
| T50 | 227° C. |
| End Point | 635° C. |
| API Gravity | 46.9 |
| Mercury Content | 5.51 ppm |
| Sulfur Content | 0.095% |

TABLE 2

| Properties of the Carbon Sorbent | |
|---|---|
| Density | 0.64 g/ml |
| Elemental Analysis: | |
| Ash | 3.8% |
| Nitrogen | 0.18% |
| Iodine Number, mg/g | >825 |
| Peroxide Number | <14 |

TABLE 2-continued

| Properties of the Carbon Sorbent | |
|---|---|
| Moisture, Wt % | <3% |
| Abrasion Number | >75 |

EXAMPLE 1

Activated carbon (25/40 mesh) was charged to a fixed bed reactor to produce an absorbent bed with a length to diameter ratio of 3:1. The reactor was sealed, and the bed was heated to a temperature of 77° C. The high mercury Argentinian Crude with the properties given in Table 1 was fed downflow to the reactor at a rate of 10 liquid hourly space velocity (LHSV). A gas stream containing 2 wt % hydrogen sulfide in hydrogen was cofed to the reactor along with the crude at a rate of 12 gas hourly space velocity (GHSV). Both streams passed downflow through the activated bed at atmospheric pressure. Samples of the treated crude were collected at various times and submitted for mercury analysis. Table 3 summarizes the results.

TABLE 3

Results for $H_2S$/C Mercury Removal Process.

| Time | Mercury concentration[a] | Mercury Removed[b] |
|---|---|---|
| Time = 0.5 hours | 15 ppb | 99.7% |
| Time = 24 hours | 35 ppb | 99.4% |
| Time = 48 hours | 22 ppb | 99.6% |
| Time = 72 hours | 24 ppb | 99.6% |

[a]Mercury concentration determined by: cold vapor atomic absorption (Analytical Consulting Services (Houston, TX)).
[b]Based on 5510 ppb initial mercury concentration of the untreated crude.

As shown in Table 3, the relative mercury removal efficiency of the hydrogen sulfide and activated carbon system is >99%. Over the course of 72 hours in this experiment, no significant changes in mercury concentration were observed. That is, there did not appear to be any breakthrough of the mercury.

EXAMPLE 2

The same reactor was charged with gamma-alumina to produce an adsorbent bed with a length to diameter ratio of 3:1. Gamma-alumina is a well known sorbent that is commonly used as a guard bed in petroleum processing. Properties of the alumina sorbent are given in Table 4. The gamma alumina was prepared by calcining a commercially available pseudoboehmite at 550° C. for three hours and tableting and sizing the resulting gamma alumina to 25/40 mesh. The same high mercury Argentinian crude, used in Example 1, was charged to the reactor at 10 LHSV and atmospheric pressure. The bed temperature was held constant at 79.4° C. Samples of the treated crude were collected at various times and submitted for mercury analysis in the same manner as in Example 1. Table 5 summarizes the results.

TABLE 4

| Properties of the Alumina Sorbent | |
|---|---|
| Surface area, $m^2/g$ | 150–220 |
| Density, g/ml | 0.48 |

TABLE 5

Results for Alumina Mercury Removal Process.

| Time | Mercury concentration[a] | Mercury Removed[b] |
|---|---|---|
| Time = 0.5 hours | 58 ppb | 98.9% |
| Time = 24 hours | 894 ppb | 83.8% |
| Time = 48 hours | 1202 ppb | 78.2% |
| Time = 72 hours | 1136 ppb | 79.4% |

[a]Mercury concentration determined by: cold vapor atomic absorption (Analytical Consulting Services (Houston, TX)).
[b]Based on 5510 ppb initial mercury concentration of the untreated crude.

As shown in Table 5, the relative mercury removal efficiency of the gamma alumina system approaches 99% only at early times. Over the course of 72 hours in this study, the mercury removal capacity of gamma alumina diminishes considerably. Although there did not appear to be any breakthrough of mercury through the sorbent bed over the course of the entire experiment, within the first 24 hours, the mercury removal capacity approaches its steady-state value of approximately 80%.

Comparison of the results shown in Table 3 and 5 clearly demonstrate the superiority of the processing technique of the present invention using hydrogen sulfide followed by contacting with an activated carbon sorbent.

Although the invention has been described in detail and with reference to specific embodiments thereof, it will be apparent to one skilled in the art that various changes and modifications can be made therein without departing from the scope and spirit of the present invention.

What is claimed is:

1. A process for removal of mercury from a mercury-contaminated hydrocarbon feedstream, the process consisting essentially of:

contacting said hydrocarbon feedstream with a feedstream-soluble sulfur compound, wherein the amount of sulfur compound contacted with the hydrocarbon feedstream is from about 0.001 to about 0.1 wt % on an elemental sulfur basis, and contacting said hydrocarbon feedstream and solubilized sulfur compound with an adsorbent selected from the group consisting of activated carbon, alumina, gold on alumina, and silver on alumina, at a temperature within the range of about 65° C. to about 232° C., to remove at least 85% of the mercury, on an elemental basis, from the hydrocarbon feedstream.

2. The process of claim 1 wherein said hydrocarbon feedstream is contacted with said sulfur compound prior to contacting said hydrocarbon feedstream with said adsorbent.

3. The process of claim 1 wherein said hydrocarbon feedstream is contacted with said sulfur compound prior to said hydrocarbon feedstream being removed from the ground.

4. The process of claim 1 wherein said feedstream is a petroleum crude oil comprising a heavy end with an upper end boiling point of greater than about 537° C.

5. The process of claim 1 wherein said sulfur compound comprises compounds or mixtures of compounds having the formula:

$$R^1—(S)_x—R^2$$

wherein x is from about 1 to about 8, and $R^1$ and $R^2$ are each, independently, hydrogen, alkyl, alkenyl, alkynyl, or aryl.

6. The process of claim 5 wherein the sulfur compound is selected from the group consisting of hydrogen sulfide, dimethylsulfide, dimethyldisulfide, or a thiol.

7. The process of claim 6 wherein the sulfur compound is hydrogen sulfide.

8. The process of claim 1 wherein the adsorbent is selected from the group consisting of activated carbon, alumina, gold on alumina, or silver on alumina.

9. The process of claim 8 wherein the adsorbent is activated carbon.

10. The process of claim 1 wherein said contacting of said feedstream with said adsorbent is carried out at about 76 to about 148° C.

* * * * *